United States Patent [19]

Brown et al.

[11] Patent Number: 4,712,496

[45] Date of Patent: Dec. 15, 1987

[54] MACHINE STITCHED BUTTONHOLE AND METHOD OF PRODUCING SAME

[75] Inventors: John Brown, Wilton, Conn.; Stephen A. Garron, Elizabeth; John W. Wurst, Chester Township, Morris County, both of N.J.

[73] Assignee: SSMC Inc., Stamford, Conn.

[21] Appl. No.: 936,006

[22] Filed: Nov. 28, 1986

[51] Int. Cl.[4] ..... D05B 3/06

[52] U.S. Cl. ..... 112/264.1; 112/447; 112/431

[58] Field of Search ..... 112/264.1, 446, 447, 112/431, 437, 65

[56] References Cited

U.S. PATENT DOCUMENTS

| | | | |
|---|---|---|---|
| 1,389,027 | 8/1921 | Coffey | 112/431 |
| 3,033,138 | 5/1962 | Bono | 112/448 |
| 3,527,183 | 9/1970 | Szostak | 112/323 |
| 3,724,404 | 4/1973 | Marsh et al. | 112/460 |
| 3,855,956 | 12/1974 | Wurst | 112/453 |
| 4,159,688 | 7/1979 | Garron et al. | 112/264.1 |
| 4,188,900 | 2/1980 | Garron et al. | 112/264.1 |
| 4,215,640 | 8/1980 | Coughenour | 112/264.1 |
| 4,458,612 | 7/1984 | Asai et al. | 112/264.1 |
| 4,502,401 | 5/1985 | Asai et al. | 112/264.1 X |

*Primary Examiner*—Peter Nerbun
*Attorney, Agent, or Firm*—Robert E. Smith

[57] ABSTRACT

A method of producing a buttonhole is disclosed in which individual legs thereof are composed of stitches alternately extending parallel to the length of the buttonhole and substantially transversely of said length. The stitches extending parallel to said length are formed at twice the stitch length and in the opposite direction of work feed from the transversely extending stitches.

2 Claims, 4 Drawing Figures

Fig. 1.
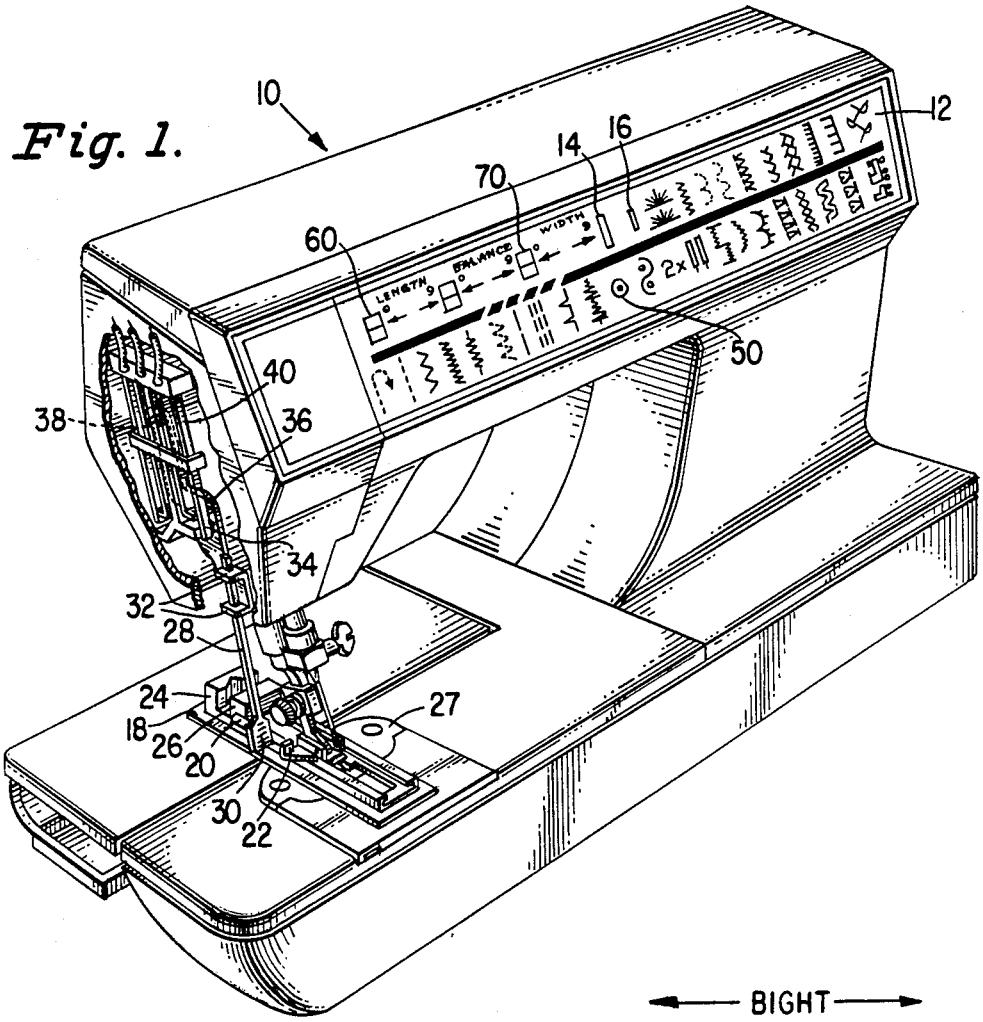
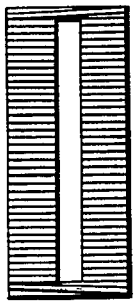
Fig. 3.
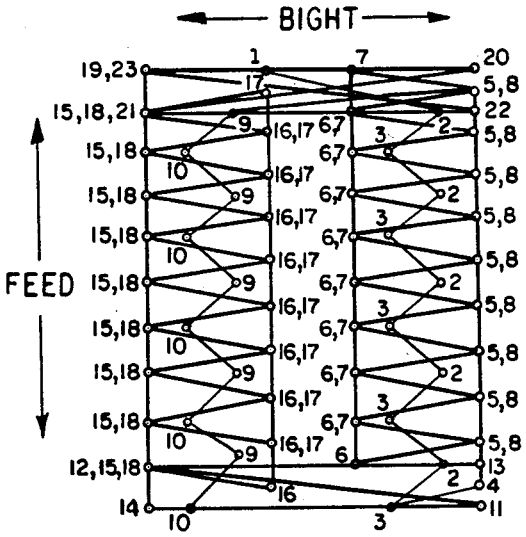
Fig. 2.

| ENCODED DATA FOR BUTTONHOLE | | | |
|---|---|---|---|
| STITCH NO. | CODE | FEED (IN.) INCREMENT | BIGHT (IN.) INCREMENT |
| 1 | 10010 01111 00 | 0.0 | 0.0 |
| 2 | 00111 00110 00 | 0.018 | 0.090 |
| 3 | 00111 01010 01 | 0.018 | 0.050 |
| 4 | 11000 00011 00 | -0.009 | 0.120 |
| 5 | 11101 00011 00 | -0.018 | 0.120 |
| 6 | 01100 01101 00 | 0.009 | 0.020 |
| 7 | 11101 01101 00 | -0.018 | 0.020 |
| 8 | 01100 00011 11 | 0.009 | 0.120 |
| 9 | 01100 10100 00 | 0.009 | -0.050 |
| 10 | 00111 11000 01 | 0.018 | -0.090 |
| 11 | 10010 00011 00 | 0.0 | 0.120 |
| 12 | 11101 11011 00 | -0.018 | -0.120 |
| 13 | 10010 00011 00 | 0.0 | 0.120 |
| 14 | 00111 11011 00 | 0.018 | -0.120 |
| 15 | 11101 11011 00 | -0.018 | -0.120 |
| 16 | 01100 10001 00 | 0.009 | -0.020 |
| 17 | 11101 10001 00 | -0.018 | -0.020 |
| 18 | 01100 11011 11 | 0.009 | -0.120 |
| 19 | 11101 11011 00 | -0.018 | -0.120 |
| 20 | 10010 00011 00 | 0.0 | 0.120 |
| 21 | 00111 11011 00 | 0.018 | -0.120 |
| 22 | 10010 00011 00 | 0.0 | 0.120 |
| 23 | 11101 11011 00 | -0.018 | -0.120 |
| 24 | 00000 11111 00 | END OF PATTERN | |

*Fig. 4.*

MACHINE STITCHED BUTTONHOLE AND METHOD OF PRODUCING SAME

DESCRIPTION

1. Field of the Invention

This invention relates to the art of buttonhole stitching on a household zigzag sewing machine with a four motion work feed mechanism, and more particularly, to a novel and improved method for producing stitched buttonholes on such sewing machines and to the highly desirable buttonhole produced thereby.

2. Background of the Invention

The stitching of a buttonhole is one of the most demanding and difficult sewing tasks to perform with complete success on a household zigzag sewing machine with a four motion work feed mechanism. The difficulties stem primarily from the arrangement of the segments of a buttonhole placing the side stitches directly opposite each other so as to highlight the slightest differentiation therebetween. Moreover, the standard of indistinguishability between adjacent sidestitching is influenced by that which is attainable in buttonholes produced by commercial sewing machines dedicated solely to stitching buttonholes and fitted with driven work clamps and the like which are not available on household sewing machines.

While attainment of indistinguishably identical sidestitching in a buttonhole would at first blush seem to be a readily attainable goal, it has in fact proven to be extremely difficult to attain. There are a number of reasons for this; first, while close spacing of the side stitches by reducing the work feed step hides appearance variation, a practical limit to the close spacing of sidestitches was imposed with prior known methods by the propensity of the sewing machine work feed to stall or jam causing an unsightly build-up of stitches upon each other.

A second reason is occasioned by the prior use of zigzag stitches in buttonhole side stitching, i.e., successive stitches extending laterally of the seam in opposite directions, which produced side stitching bordered by a series of sharp points, not only jagged in appearance but condusive to highlighting the slightest difference in stitch density.

A third reason involves a characteristic which can occur in most household sewing machines referred to in the art as "half hitching". This involves the formation of a twist in the concatenated needle and bobbin threads on certain needle penetrations, as along one side of a zigzag stitch pattern. In zigzag stitching, the two limbs of thread from each needle penetration extend at such a slight angle to each other that when a half hitch is formed the location of the twist in the threads can vary laterally of the stitch pattern in response to minute variations in thread tension or the like thus to adversely influence the appearance and symetry of buttonhole side stitching.

DESCRIPTION OF THE PRIOR ART

The U.S. Pat. No. 2,977,913, Apr. 4, 1961 of Schenkengel discloses a method of sewing the parallel rows of zigzag side stitching of a buttonhole all in the same direction of work feed in an effort to arrive at uniformity. In the U.S. Pat. No. 4,159,688, July 28, 1978 of Odermann et.al., narrow cording stitches are overlaid by wider zigzag covering stitches to give a crowned appearance to the buttonhole side stitching. The U.S. Pat. No. 4,215,640, Aug. 5, 1980 of Coughenour employs the mirror image feature of modern electronically controlled sewing machines in an effort to produce symmetry between opposite side stitches of a buttonhole.

SUMMARY OF THE INVENTION

The influence of each of the factors discussed above adversely affecting the identical appearance of buttonhole side stitches is exhibited in some degree in each of the prior art patents disclosed above. In the present invention however, the effect of these factors is either obviated or reduced to insignificance.

In accordance with this invention buttonhole side stitching is performed by executing a stitch pattern in which the stitches extending between successive needle penetrations are arranged alternately in the direction parallel to the buttonhole and transversely thereof. Alternate stitches in this stitch pattern differ from each other in two additional ways; first, those stitches extending parallel to the buttonhole are formed by a sewing machine work feed motion in one direction, while the transversely extending stitches are formed by a work feed motion in the opposite direction; and second, the length of work feed for each of the stitches extending parallel to the buttonhole is twice that of the work feed step executed during formation of each of the transversely extending stitches.

The stitch pattern taught by this invention is known as a "Turkish hem" and has been used heretofore as a decorative stitch for other than buttonhole sewing applications.

By using the above described stitch pattern for buttonhole side stitching the alternate stitches at twice the stitch length of the laterally jogged stitches practically eliminate stalling or jamming even at the finest stitch length settings. The side stitches parallel to the length of the buttonhole produce smooth straight edges along each of the buttonhole sidestitches thus avoiding the jagged edge appearance of zigzag stitching which highlights even minute variations. The substantially right angle between each successive side stitch in the stitch pattern taught by this invention forces the cross-over of threads whenever a "half hitch" is formed to remain substantially coincident with the needle penetration so that the laterally extending threads of the side stitching each extend fully across the side stitching and all such laterally extending threads appear to be perfectly parallel to each other.

As a result this invention makes it possible to produce side stitching at opposite sides of a buttonhole which appears indistinguishably symetrical and identical dispite substantial variation in thread tension, work feed conditions, and the like.

DESCRIPTION OF THE DRAWINGS

With the above and additional objects and advantages in view, as will hereinafter appear, the invention will now be described with reference to the accompanying drawings in which:

FIG. 1 is a perspective view of a sewing machine on which the buttonhole of this invention may be produced and the method according to this invention may be practiced, FIG. 2 is a diagramatic plan view representing a buttonhole stitched in accordance with this invention with the spacing between successive needle penetrations exaggerated more clearly to illustrate the stitch pattern, FIG. 3 is a plan view of a buttonhole stitched according to this invention showing stitch density suitable for actual buttonhole stitching, and FIG. 4 is a table of encoded data for producing a buttonhole pattern in accordance with the method of this invention.

DESCRIPTION OF THE PREFERRED EMBODIMENT

Referring to the drawings, FIG. 1 illustrates a sewing machine indicated generally at 10 having a control panel 12 illustratively of the type utilizing a continuous planar element such as a glass panel to which circuitry is applied as by deposition or the like to provide controls sensitive to the touch of an operators finger. Indicated on the control panel 12 are touch sensitive areas having respective representations of various stitch patterns which may be automatically sewn by the sewing machine 10.

The sewing machine 10 is provided with the capability of sewing either a large buttonhole, indicated by the large buttonhole representation 14 on the control panel 12, or a small buttonhole, indicated by the small buttonhole representation 16 on the control panel. When a buttonhole pattern is to be sewn, a buttonhole presser foot 18 is installed on the sewing machine 10. The buttonhole presser foot 18 includes a fixed rear stop member 20 and an adjustable front stop member 22, the distance therebetween defining the length of the buttonhole being sewn, as determined by the size of button inserted between an anchor element 24 and a buttonhole gauging element 26. It will be understood that the lengthwise extent of the stitches forming the buttonhole is influenced by operation of the sewing machine work feeding mechanism which in household sewing machines is almost invariably of the four motion variety such as is disclosed in U.S. Pat. No. 3,527,183, issued on Sept. 8, 1970 to J. Szostak which is incorporated by reference herein. In a four motion work feed mechanism, a work feeding instrumentality is moved in an elliptical path upwardly through cloth in the sewing machine throat plate 27 into feeding engagement with work being stitched and downwardly beneath the throat plate for an idle return stroke.

The sewing machine 10 further includes a switch mechanism including a lever arm 28 terminating in a paddle 30 at its lower end. The other end of the lever arm 28 is received by openings in a pair of space lugs 32 formed on one end of a lever 34. The lever arm 28 may, therefore, be selectively raised and lowered by an operator, the operator lowering the lever arm 28 so that the paddle 30 is intermediate the stops 20 and 22 during the formation of a buttonhole pattern. The lever 34 is pivoted at 36; and at the end opposite the lug 32 has a pin 38 mounted thereon for cooperation with an electrical switch member 40. Manipulation of the paddle 30 on both ends of the buttonhole causes actuation of the electrical switch member 40, which actuation is fed to the electronic control unit for the sewing machine in order to initiate the next of a sequence of steps in the formation of a buttonhole. For further information with respect to the operation of the electrical switch member 40 and the electronic control package of the sewing machine, the reader is referred to U.S. Pat. No. 4,159,688 issued on July 3, 1979 to S. A. Garron et al, the disclosure of which application is hereby incorporated by reference herein.

In addition to control panel 12 controls for influencing various stitch patterns, the control panel also has thereon a control 50 for influencing the operation of the sewing machine in the production of just a single example of any selected stitch pattern, as well as stitch length adjusting controls 60 stitch width controls 70 and the like.

Basic information on operation of electronic controls of the sewing machine 10 may be obtained by reference to the U.S. Pat. No. 3,855,956 issued on Dec. 24, 1974 to Wurst, which patent is hereby incorporated by reference herein. In that patent is disclosed the use of solid state memory storing digital information related to the positional coordinates for each stitch of a predetermined stitch pattern. A pulse generator driven in timed relation with the sewing machine produces a timing signal pulse between each successive stitch. The signal pulses are counted in a counter to provide a timed series of progressively increasing binary numbers corresponding to the progressively increasing number of stitches in the pattern. The counter output is applied as the address to the memory to recover therefrom the digital information related to the positional coordinates for each stitch of the predetermined pattern. The memory output is applied to control driving devices operatively connected to impart a controlled range of movement to the conventional stitch forming instrumentalities of the sewing machine to produce a specific predetermined position coordinate for the needle penetration during each stitch.

Referring now to FIG. 2, there is shown a representation in plan view of a buttonhole pattern of stitches sewn in accordance with this invention, as for instance when a large buttonhole is selected for execution upon operator influence of the large buttonhole representation 14 on the control panel 12. The needle penetrations in the buttonhole are indicated by small open circles with the stitch number closely adjacent thereto.

Coordinate data for the needle penetrations are shown in the table of FIG. 4 wherein for each stitch point there is listed the digital code word for the work feed increment or decrement and for the bight position. In the digital code word the first five bits represent the feed increment information and the next five bits represent the bight position. The eleventh and twelfth bits provide instructions for repeating a prior stitch or group of stitches; a code 01 instructs repeat of one prior stitch, while a code 11 instructs a repeat of a group of the four prior stitches. Manipulation of the electrical switch member 40 by the buttonhole presser foot 18 reaching either extremity of the buttonhole terminates the influence of whichever repeat code may be effective.

As illustrated in FIGS. 2 and 4, after the initial needle penetration 1, stitches 2 and 3 are formed and repeated to provide the underlying cording stitches of the right hand side stitching of the buttonhole continuing until the length of buttonhole as set in the buttonhole presser foot is reached and indicated by operation of switch 40. Thereafter covering stitches 4 to 8 are formed over the cording stitches 2 and 3 in a pattern in which the succession from stitch 4 to stitch 5 extends in a large stitch length (0.018 inch) parallel to the length of the buttonhole toward the beginning of buttonhole stitching, the succession from stitch 5 to stitch 6 extends transversely of the buttonhole in the opposite direction and at one half the stitch length (0.009 inch), the succession from stitch 6 to stitch 7 parallel to the buttonhole in the same direction and length as that from stitch 4 to stitch 5, and the succession from stitch 7 to stitch 8 transversely of the buttonhole in the opposite direction and at one half the stitch length (0.009 inch).

The pattern of four stitches 4 to 8 is repeated until the length of the buttonhole as set in the buttonhole presser foot is returned and indicated by operation of the switch 40. Thereafter, stitches 9 and 10 are formed and repeated to provide the cording stitches of the left hand side stitching in the same manner as cording stitches 2 and 3.

Upon termination of cording stitches 9 and 10 by operation of switch 40, barring stitches 11 to 14 are formed following which covering stitches 15, 16, 17 and 18 are formed over the cording stitches 9 and 10. The covering stitches 15, 16, 17 and 18 are arranged in the same pattern as are the covering stitches 5, 6, 7 and 8, and upon termination of the repeat of the four stitch pattern 15, 16, 17 and 18 by operation of the switch 40, barring stitches 19, 20, 21, 22 and 23 are formed following which the buttonhole stitch pattern is terminated and stitching of the buttonhole is completed.

The novel buttonhole of this invention and the method of producing it by employing a stitch pattern of alternate stitches parallel and transverse to the length of the buttonhole may also be produced on cam controlled sewing machines employing either two step or four step buttonhole mechanisms.

The U.S. Pat. No. 3,724,404 of W. H. W. Marsh et al issued Apr. 3, 1973 which is incorporated herein by reference discloses a two step buttonhole mechanism, each step including control setting to form the side stitching at one side of the buttonhole plus a bar tack at one end of the buttonhole.

The U.S. Pat. No. 3,033,138 of L. Bono issued May 8, 1962, which is incorporated herein by reference discloses a four step buttonhole mechanism, each side stitching and bar tacking operation being influenced by a separate operator controlled setting of the buttonhole mechanism.

In order to produce a buttonhole in accordance with this invention using either the two step or four step buttonhole mechanisms of the Marsh et al or Bono patents referred to above a modification of the sewing machines disclosed therein is required in that a stitch patterning cam must be provided and rendered effective during buttonholing to produce the Turkisk hem stitch pattern at least during the side stitching. The Turkisk hem stitch pattern may also be used to form the barring stitches at each end of the buttonhole, and where the stitch pattern is cam controlled, as in the Marsh et al and Bono patents referred to above use of the same pattern of stitches on side and barring stitches, modified only as to width position and an appropriate repeat is preferrable as a practical matter.

Having set for the nature of this invention, what is claimed herein is:

1. A method of producing a buttonhole on a sewing machine having a needle, mechanism for jogging said needle laterally, a four motion work feed mechanism, and pattern means for controlling said needle jogging and work feeding mechanisms, comprising the steps of:

sequentially stitching a leg along each side of said buttonhole and a bar spanning both said legs at each end of said buttonhole, utilizing said pattern means at least during stitching of each leg of said buttonhole to implement a stitch pattern in which stitches extend alternately parallel to the length of said buttonhole and substantially transversely of the length of said buttonhole, said stitches extending parallel to the length of said buttonhole being formed at twice the stitch length and in the opposite direction of work feed from said transversely extending stitches.

2. A stitched buttonhole including spaced parallel rows of side stitches and a bar of stitches at each end spanning both rows of side stitches, each of said rows of side stitches being formed in a pattern in which successive stitches are arranged alternately parallel to the length of said rows and substantially transversely thereof, said stitches which are arranged parallel to the length of said rows each extending along said rows in the opposite direction and a distance twice that of said transverse stitches.

* * * * *